US005518809A

United States Patent [19]

Henry et al.

[11] Patent Number: 5,518,809

[45] **Date of Patent: *May 21, 1996**

[54] WATER-BASED TRANSPARENT IMAGE RECORDING SHEET FOR PLAIN PAPER COPIERS

[75] Inventors: Robert M. Henry, Round Rock; Dwight L. Evans, Cedar Park; Manisha Sarkar, Austin, all of Tex.

[73] Assignee: Minnesota Mining and Manufacturing Company, St. Paul, Minn.

[ * ] Notice: The term of this patent shall not extend beyond the expiration date of Pat. No. 5,310,595.

[21] Appl. No.: 186,426

[22] Filed: Jan. 25, 1994

Related U.S. Application Data

[63] Continuation-in-part of Ser. No. 114,593, Oct. 12, 1993, abandoned, which is a continuation-in-part of Ser. No. 30,699, Mar. 12, 1993, Pat. No. 5,310,591, which is a continuation-in-part of Ser. No. 947,252, Sep. 18, 1992, Pat. No. 5,310,595.

[51] Int. Cl.[6] ..... B41M 5/00

[52] U.S. Cl. ..... 428/327; 428/195; 428/206; 428/500; 428/520

[58] Field of Search ..... 428/327, 195, 428/206, 520, 500; 346/135.1

[56] References Cited

U.S. PATENT DOCUMENTS

| | | | |
|---|---|---|---|
| 4,480,003 | 10/1984 | Edwards et al. | 428/329 |
| 4,684,561 | 8/1987 | Imai et al. | 428/141 |
| 4,912,009 | 3/1990 | Amering et al. | 430/137 |
| 4,952,650 | 8/1990 | Young et al. | 526/194 |
| 5,104,721 | 4/1992 | Sun | 428/206 |
| 5,104,731 | 4/1992 | Gager | 428/323 |
| 5,200,254 | 4/1993 | Henry et al. | 428/195 |
| 5,252,535 | 10/1993 | Martin et al. | 428/195 |
| 5,310,591 | 5/1994 | Dodge et al. | 428/195 |
| 5,310,595 | 5/1994 | Ali et al. | 428/195 |

FOREIGN PATENT DOCUMENTS

| | | | |
|---|---|---|---|
| 1289838A | 11/1989 | Japan | B29C 55/02 |

*Primary Examiner*—Pamela R. Schwartz
*Attorney, Agent, or Firm*—Gary L. Griswold; Walter N. Kirn; Darla P. Neaveill

[57] ABSTRACT

An image recording sheet comprising a substrate having an imaging surface and an opposing surface, the opposing surface having coated thereon a feed facilitation layer comprising a copolymer formed from at least one monomer selected from the group consisting of bicyclic alkyl (meth) acrylates, aliphatic alkyl (meth)acrylates having from one to 12 carbon atoms, aromatic (meth)acrylates, and a polar monomer having the formula:

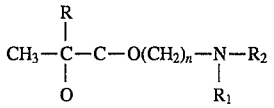

wherein R is hydrogen or methyl, $R_1$ and $R_2$ may be hydrogen, identical or differing alkyl groups having up to 8 carbon atoms, preferably up to 2 carbon atoms, or the quaternary cationic salts thereof, at least one long chain polymeric particle having good antifriction characteristics and optionally, an antistatic agent selected from the group consisting of cationic agents, anionic agents, fluorinated agents, and nonionic agents.

12 Claims, No Drawings

WATER-BASED TRANSPARENT IMAGE RECORDING SHEET FOR PLAIN PAPER COPIERS

This application is a-continuation-in-part of Ser. No. 08/114,593, filed Oct. 12, 1993, now abandoned which was a continuation-in-part of Ser. No. 08/030,699, filed Mar. 12, 1993, now U.S. Pat. No. 5,310,591 which was a continuation-in-part of Ser. No. 07/947,252, filed Sep. 18, 1992 now U.S. Pat. No. 5,310,595.

BACKGROUND OF THE INVENTION

1. Field of the Invention

This invention relates to transparent recording materials suitable for use in facilitating feeding in copying and printing devices. Specifically, it relates to coatings for transparencies having specific physical properties for use in overhead projectors.

2. Description of Related Art

Many different types of transparent image receptive sheets or receptors are known in the art. Typically, these transparent sheets are comprised of thin films of one or more organic resins such as polyesters, overcoated with an image receptive layer on one side, and sometimes on both sides. They can be used as receptors for different printing and imaging methods, such as thermal transfer printing, ink-jet printing and plain paper copying to produce transparencies suitable for use with commercially available overhead projectors.

In thermal mass transfer imaging or printing, an image is formed on a receptor sheet when a donor sheet or ribbon is brought in intimate contact with the receptor sheet and heated. Colored material to be transferred from the donor is selected by a thermal printhead having small, electrically heated elements operated by signals from a computer, and the material is transferred to areas of the receptor sheet in an image-wise manner. A full colored image is generated in at least 3 passes comprising yellow, cyan and magenta print cycles. In the formation and development of xerographic images, a toner composition comprised of resin particles and pigment particles is generally applied to a latent image generated on a photoconductive member. Thereafter, the image is transferred to a receptor and affixed there, by the application of heat, pressure, or a combination thereof. In either the printing or copying process, the image receptive sheets are fed through the respective devices either singly or continuously from a stack. During continuous feeding, multiple feeding tendencies are present, usually leading to jams, unless the image receptors specifically incorporate some feeding aids either in the image receptive layer or as a coating on the side of the receptor opposite the imaging side to facilitate feeding. In some cases, a backing sheet is used to facilitate this feeding process.

U.S. Pat. No. 5,200,254 (Henry et al) discloses a receptor sheet manifold for thermal mass transfer imaging comprising a polymeric image receptor sheet and a non-transparent backing sheet attached thereto. The image receptor sheet has a substrate film having an image receptive layer coated on at least one surface thereof. The image receptive layer comprises an imaging polymer, a perfluoroalkylsulfonamidopolyether antistatic agent and silica particles. The non-transparent backing sheet has a contact surface touching the receptor sheet of the manifold, and an opposing surface having a coating composition comprising a resin binder, an antistatic agent or agents, and a particulate, such that this opposing surface has a Bekk smoothness of about 450 to about 550 Bekk seconds.

Japanese Patent No. 1289838A discloses a composite polyester film having a cover layer comprising a concentration of sulfonic acid or sulfonate on at least one surface. The composite film is taught to eliminate "pile traveling" (simultaneous feeding of more than one sheet), and yield excellent transparency flatness, and easy toner adhesion.

U.S. Pat. No. 4,480,003 discloses a transparency film for use in plain paper electrostatic copiers. The base of the transparency film is a flexible, transparent, heat resistant polymeric film. An image receiving layer, preferably, a toner-receptive, thermoplastic, transparent polymethyl methacrylate polymer containing dispersed silica particles is coated On a first major surface of the polymeric film. On the second major surface of the film base is coated a layer of non-migratory electrically conductive material, preferably a polymer derived from the reaction of pyridine and 2 aminopyridine with partially chloromethylated polystyrene. It is preferred that a primer coating be interposed between the polymeric film base and the layer of conductive material to provide suitable adhesion of the coating to the film base. It is also preferred that the layer of conductive material be over-coated with a protective coating having additives to control abrasion, resistance, roughness and slip properties. It is disclosed that the sheet can be fed smoothly from a stack and produces clear background areas.

U.S. Pat. No. 5,104,721 discloses a medium for electrophotographic printing or copying comprising a polymeric substrate coated with a polymeric coating having a Tukon hardness of about 0.5 to 5.0 and a glass transition temperature of about 5° to 45° C. The coating comprises at least one pigment which provides a coefficient of static friction of from 0.20 to 0.80 and a coefficient of dynamic friction of from 0.10 to 0.40. The medium has improved image quality and toner adhesion. It is particularly useful in laser electrophotographic printing. The polymer employed in the coating can contain thermosetting or thermoplastic resins, and preferably aqueous acrylic emulsions such as Rhoplex™ resins from Rohm and Haas.

U.S. Pat. No. 5,104,731 discloses a dry toner imaging film media having good toner affinity, anti-static properties, embossing resistance and good feedability through electrophotographic copies and printers. The media comprises a suitable polymeric substrate with an antistatic matrix layer coated thereon. The matrix layer has resistance to blocking at 78° C. after 30 minutes and a surface resistivity of from about $1\times10^8$ to about $1\times10^4$ ohms per square at 20° C. and 50% relative humidity. The matrix contains one or more thermoplastic polymers having a $T_g$ of 5° C. to 75° C., and at least one crosslinked polymer which is resistant to hot roll fuser embossing, at least one of the polymers being electrically conductive.

U.S. Pat. No. 4,684,561 discloses a multilayer color sheet for thermal transfer printing comprising a substrate having a colorant layer on one side of the substrate and a resin layer formed on the other side of the substrate. The resin layer comprises fine particles of a solid material, at least one lubricating material and a polymer resin so that the resin layer is made irregular on the surface thereof due to the presence of the fine particles. The anti-stick effect can be developed more effectively when using two or more surface active agents, liquid lubricants and solid lubricants in composition. The fine particles may be made of various materials, such as metals, inorganic materials and organic materials. Preferred particles include synthetic amorphous silica, carbon black, alumina titanium oxide, calcium silicate, aluminum silicate and the like.

Although there are a host of image receptive coatings disclosed in the art, the means for facilitating feeding from a stack is disclosed in only a few instances. In some of these instances, the coating is coated on a backing sheet, rather than on the imaging receptor, and to be remove after imaging, so that it will not interfere with the projected image. The choice of coatings is therefore not severely restricted, and low haze coatings are not required. Thus, there remains a need for low haze coatings that can be coated directly onto the non-imaging surface of the receptor to aid in stack feeding, thus eliminating the use of backing sheets, especially for use with thermal mass printers.

The present inventors have now discovered a class of polymers that can be coated from an aqueous medium onto the non-imaging side of a receptor to facilitate stack feeding.

SUMMARY OF THE INVENTION

The invention provides a transparent image receptor for use in a thermal mass printing application. The receptor comprises a transparent polymeric substrate, one major surface being an imaging surface, and having coated on the opposing surface, a water-based feed facilitation coating which aids in stack feeding by greatly reducing or eliminating multiple feeding tendencies, comprising:

a) from about 65 to about 99.9 parts of a transparent film-forming polymer;

b) from about 0.1 to about 15 parts of at least one polymeric particle; and c) from 0 to about 20 parts of an antistatic agent selected from the group consisting of cationic agents, anionic agents, fluorinated agents, and nonionic agents, said coating being coated onto said transparent substrate at a time during the manufacture of said image receptive film selected from the group consisting of a) before orientation of said substrate, b) after uniaxial orientation, and c) after biaxial orientation.

The image receptive layer can be coated onto said substrate either before, at the same time, or after the feed facilitation coating is coated.

Preferred water-based feed facilitation coatings of the invention comprise a) from about 65 to about 99.9 parts of a transparent film-forming copolymer formed from 1) from about 80 parts to about 100 parts of at least one monomer selected from the group consisting of bicyclic alkyl (meth)acrylates, aliphatic alkyl (meth-)acrylates having from about one to 12 carbon atoms, aromatic (meth)acrylates, and 2) from 0 to about 20 parts of a polar monomer having the formula:

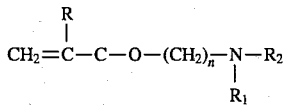

wherein R is hydrogen or methyl, $R_1$ and $R_2$ is selected from the group consisting of hydrogen, identical, and differing alkyl groups having up to 8 carbon atoms, preferably up to 2 carbon atoms; the N-group can also comprise a cationic salt thereof;

b) from about 0.1 parts to about 15 parts of a particulate filler system comprising at least one polymeric particle having an average particle size of from 0.25 μm to 15 μm, comprising 1) at least 20 parts by weight polymerized diol di(meth)acrylate having a formula $CH_2{=}CR^2COOC_nH_{2n}OOCR^2{=}CH_2$ wherein $R^2$ is hydrogen or a methyl group, and n is an integer from 4 to 18, 2) from 0 to 80 parts of at least one copolymerized vinyl monomer having the formula $CH_2{=}CR^2COOC_mH_{2m+1}$ wherein $R^2$ is hydrogen or a methyl group and m is an integer of from 12 to 40, and 3) from 0 to 30 parts of at least one copolymerized ethylenically unsaturated monomer selected from the group consisting of vinyl esters, acrylic esters, methacrylic esters, styrene, derivatives thereof, and mixtures thereof; and c) from 0 to about 20 parts of an antistatic agent selected from the group consisting of cationic agents, anionic agents, fluorinated agents, and nonionic agents, said coating being coated onto said substrate during the manufacturing thereof.

In a highly preferred embodiment, an image receptive layer suitable for thermal imaging is coated on the imaging surface of the substrate, and the feed facilitation coating comprises a bimodal particulate filler system, having narrow particle size distributions, i.e., a standard deviation of up to 20% of the average particle size.

This feed facilitation coating can be emulsion or aqueous solution coated using well-known coating techniques. For emulsion coating, at least one nonionic emulsifier having a hydrophilic/lipophilic balance (HLB) of at least about 10 should also be present. For solution coated sheets, the polar monomer is a cationic salt selected from the group consisting of

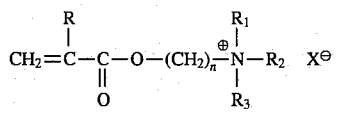

wherein R is hydrogen or methyl, $R_1$ and $R_2$ may be hydrogen, identical or differing alkyl groups having up to about 8 carbon atoms, preferably up to 2 carbon atoms, $R_3$ is an alkyl group having up to about twenty carbon atoms containing a polar group such as —OH, —$NH_2$, COOH, and X is a halide. To make the polymer water soluble, it is preferred that the cationic monomer contain fewer carbon atoms.

Optionally, a crosslinker may also be present. The coating polymer can be prepared using any typical emulsion polymerization technique in an aqueous medium.

As used herein, these terms have the following meanings:

1) The term "feed facilitation coating" means a water-based coating that, when coated onto a substrate as described herein, will result in a substantial reduction of multiple feeds during stack feeding over a substrate without such coating.

2) The term "(meth)acrylate" means both acrylate and methacrylate.

3) "Imaging surface" means the surface which is intended to be imaged in a thermal printer.

The parts, percents, and ratios herein are all by weight, unless otherwise specifically stated.

DETAILED DESCRIPTION OF THE INVENTION

Image-receptive sheets of the invention have a substrate with an image-receptive coating coated on one major surface thereof, and a "feed facilitation" coating on the opposing surface.

This water-based "feed facilitation" coating comprises from about 65 parts to about 99.9 parts of a film forming polymer, which can be any polymer, copolymer or polymer blend capable of water-based emulsion coating or aqueous solution coating, using conventional coating techniques. Such polymers can be made from any ethylenically unsaturated monomers and can include acrylates and methacrylates, styrenes, substituted styrenes and vinylidine chlorides.

The film forming polymer contains from about 80 parts to 100 parts of at least one monomer selected from the group consisting of bicyclic alkyl (meth)acrylates, aliphatic alkyl (meth)acrylates having from one to twelve carbon atoms, and aromatic (meth)acrylates.

Useful bicyclic (meth)acrylates include, but are not limited to, dicyclopentenyl (meth)acrylate, norbornyl (meth-)acrylate, 5-norborene-2-methanol, and isobornyl (meth-)acrylate. Preferred bicyclic monomers include dicyclopententyl (meth)acrylate, and isobornyl (meth)acrylate.

Useful aliphatic alkyl (meth)acrylates include, but are not limited to, methyl acrylate, ethyl acrylate, methyl (meth-)acrylate, isobutyl (meth)acrylate, isodecyl (meth)acrylate, cyclohexyl (meth)acrylate, and the like. Preferred aliphatic monomers include methyl (meth)acrylate, ethyl (meth)acrylate, and isodecyl (meth)acrylate.

Useful aromatic (meth) acrylates include, but not limited to benzyl(meth)acrylate and styrene (meth)acrylate.

The polymer can also contain from 0 to 20 parts of a polar monomer having the formula:

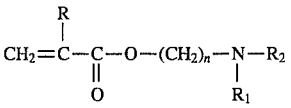

wherein R is hydrogen or methyl, $R_1$ and $R_2$ is selected from the group consisting of hydrogen, identical, and differing alkyl groups having up to 8 carbon atoms, preferably up to 2 carbon atoms; the N-group can also comprise a cationic salt thereof.

Useful examples include N,N-dialkyl monoalkyl amino ethyl (meth)acrylate, and N,N-dialkyl monoalkyl amino methyl (meth)acrylate, N-butyl amino ethyl (meth)acrylate, and the like for emulsion polymers, and quaternary ammonium salts thereof for solution polymers. Preferred monomers include N,N'-diethylaminoethyl(meth)acrylate, and N,N'-dimethylaminoethyl(meth)acrylate for emulsion polymers and bromoethanol salts of N,N'-dimethyl aminoethyl-(meth)acrylate, and N,N'-diethyl aminoethyl(meth)acrylate for solution polymers.

The presence of these polar monomers improves the adhesion of the coating to the transparent film substrate or backing.

Preferred film forming polymers comprise at least two monomers selected from aliphatic alkyl (meth)acrylate monomers, bicyclic alkyl (meth)acrylates monomers and aromatic (meth)acrylates.

The feed facilitation coating also contains at least one polymeric particle. Useful polymeric particles range from about 1 μm to about 15 μm in diameter and include such polymers as poly(methylmethacrylate) (PMMA), modified poly(methylmethacrylate), poly(tetrafluorethylene), polyethylene, and particles produced from diol di(meth)acrylate homopolymers which impart antifriction characteristics when coated on image recording sheets. These diol di(meth)acrylates can be reacted with long-chain fatty alcohol esters of (meth)acrylic acid.

Preferred water-based feed facilitation coatings contain particles selected from PMMA, modified PMMA, and particles produced from diol-di(meth)acrylate homopolymers or copolymers of diol di(meth)acrylates reacted with long-chain fatty alcohol esters of (meth)acrylic acid.

Specifically such microspheres comprise at least about 20 percent by weight polymerized diol di(meth)acrylate having a formula $$CH_2{=}CR_2COOC_nH_{2n}OOCCR_2{=}CH_2$$

wherein $R_2$ is hydrogen or a methyl group, and n is an integer from 4 to 18. Examples of these monomers include those selected from the group consisting of 1,4-butanediol di(meth)acrylate, 1,6-hexanediol di(meth)acrylate, 1,8-octanediol di(meth)acrylate, 1,10-decanediol di(meth) acrylate, 1,12-dodecanediol di(meth)acrylate, 1,14-tetradecanediol di(meth)acrylate, and mixtures thereof.

Preferred monomers include those selected from the group consisting of 1,4-butanediol di(meth)acrylate, 1,6 hexanediol di(meth)acrylate, 1,12-dodecanediol di(meth) acrylate, and 1,14-tetradecanediol di(meth)acrylate.

The microspheres may contain up to about 80 weight percent of at least one copolymerized vinyl monomer having the formula $$CH_2{=}CR_2COOC_mH_{2m+1}$$

wherein $R^2$ is hydrogen or a methyl group and m is an integer of from 12 to about 40.

Useful long-chain monomers include, but are not limited to lauryl (meth)acrylate, octadecyl (meth)acrylate, stearyl (meth)acrylate, and mixtures thereof, preferably stearyl (meth)acrylate.

The microspheres may optionally contain up to about 30 percent by weight of at least one copolymerized ethylenically unsaturated monomer selected from the group consisting of vinyl esters such as vinyl acetate, vinyl propionate, and vinyl pivalate; acrylic esters such as methacrylate, cyclohexylacrylate, benzylacrylate, isobornyl acrylate, hydroxybutylacrylate and glycidyl acrylate; methacrylic esters such as methyl methacrylate, butyl methacrylate, cyclohexyl methacrylate, benzyl methacrylate, γ-methacryloxypropyl trimethoxysilane, and glycidyl methacrylate; styrene; vinyltoluene; α-methyl styrene, and mixtures thereof.

Most preferred microspheres include 50/50 poly(hexanediol-diacrylate/stearyl methacrylate), and 50/50 poly(butanediol-diacrylate)/lauryl(meth)acrylate, 80/20 poly(hexanediol-diacrylate)/stearyl(meth)acrylate, 50/50 polymethylmethacrylate/1,6 hexanedioldiacrylate, $C_{14}$ dioldiacrylate, and $C_{12}$ dioldi(meth)acrylate.

In addition to the above, microspheres of the present invention may also comprise additives which are not ethylenically unsaturated, but which contain functional groups capable of reacting with materials containing reactive groups which may also be coated on the substrate along with the microspheres. Such additives are useful in modifying the degree of interaction or bonding between the microspheres and the imaging polymer. Suitable examples include organosilane coupling agents having alkyl groups with 1 to 8 carbon atoms, such as glycidoxy trimethoxysilanes such as γ-glycidoxypropyltrimethoxysilane, and (aminoalkylamino) alkyl trimethoxysilanes such as 3-(2-amino ethyl amino) propyl trimethoxysilane.

For good feedability, the mean particle size preferably ranges from 0.25 μm to 15 μm. Particles smaller than 0.25 μm would require the use of more particles to produce an effective coefficient of friction, this would tend to also produce more haze. Larger particles than 15 μm would require thicker coatings to anchor the particles firmly in the coatings, which would increase haze and coating cost. For good performance, the particles preferably have narrow particle size distributions, i.e., a standard deviation of up to 20% of the average particle size. These ranges are preferably 0.1–0.7 μm, 1–6 μm, 3–6 μm, 4–8 μm, 6–10 μm, 8–12 μm, 10–15 μm. More preferred particles are those having bimodal particle size distributions. This is made by mixing particles having 2 different particle size distributions such as particles having a distribution of sizes from 1– 4 μm mixed with 6–10 μm.

When bimodal particles are used, both particles can be selected from the preferred polymeric beads described above, or one of the particles can be a preferred microsphere and the other may be selected from other particles such as PMMA and polyethylene particles. If so, the second type of particle also preferably has a narrow particle size distribution.

Most preferably, both bimodal particles are selected from particles produced from the copolymer of hexanedioldiacrylate and stearylmethacrylate, having particle size distributions of from 1 to 4 μm and from 6 to 10 μm, or from 2 to 6 μm and from 8 to 12 μm, or from 0.20 to 0.5 μm and from 1–6 μm.

The microspheres are polymerized by means of conventional free-radical polymerization, e.g., those suspension polymerization methods described in U.S. Pat. Nos. 4,952,650, and 4,912,009, or by suspension polymerization using a surfactant as the suspending agent, and use those initiators normally suitable for free-radical initiation of acrylate monomers. These initiators include azo compounds such as 2,2-azobis, 2-methyl butyronitrile and 2,2-azobis (isobutyronitrile); and organic peroxides such as benzoylperoxide and lauroylperoxide. For submicron beads, suspension polymerization is used wherein the suspending agent is a surfactant.

An antistatic agent may also be present in the feed facilitation coating. Useful agents are selected from the group consisting of nonionic antistatic agents, cationic agents, anionic agents, and fluorinated agents. Useful agents include such as those available under the trade name AMTER™, e.g., AMTER™ 110, 1002, 1003, 1006, and the like, derivatives of Jeffamine™ ED-4000, 900, 2000 with FX8 and FX10, available from 3M, Larostat™ 60A, and Markastat™ AL-14, available from Mazer Chemical Co., with the preferred antistatic agents being steramidopropyldimethyl-β-hydroxy-ethyl ammonium nitrate, available as Cyastat™ SN, N,N'-bis(2-hydroxyethyl)-N-(3 '-dodecyloxy-2'2-hydroxylpropyl) methylammonium methylsulfate, available as Cyastat™ 609, both from American Cyanamid.

When the antistatic agent is present, amounts of up to about 20% (solids/solids) may be used. Preferred amounts vary, depending on coating weight. When higher coating weights are used, 1–10% is preferred; when lower coating weights are used, 5–15% is preferred.

Where emulsion polymerization of the polymer is desired, an emulsifier is also present. The emulsifiers include nonionic, or anionic emulsifiers, and mixtures thereof, with nonionic emulsifiers being preferred. Suitable emulsifiers include those having a HLB of at least 10, preferably from 12 to 18.

Useful nonionic emulsifiers include $C_{11}$ to $C_{18}$ polyethylene oxide ethanol, such as Tergitol™, especially those designated series "S" from Union Carbide Corp., those available as Triton™ from Rohm and Haas Co., and the Tween™ series available from ICI America.

Useful anionic emulsifiers include sodium salts of alkyl sulfates, alkyl sulfonates, alkylether sulfates, oleate sulfates, alkylarylether sulfates, alkylarylpolyether sulfates, and the like. Commercially available examples include such as those available under the trade names Siponate™ and Siponic™ from Alcolac, Inc.

When used, the emulsifier is present at levels of from 1% to 7%, based on polymer, preferably from 2% to 5%.

Additional wetting agents with HLB values of from about 7 to about 10 may be present in the emulsion to improve coatability. These additional surfactants are added after polymerization is complete, prior to coating onto the polymeric substrate. Preferred additional wetting agents include fluorochemical surfactants such as $$C_8F_{17}SO_2N(C_2H_5)-(C_2H_4O)_nR$$

wherein n is from 6 to 15 and R can be hydrogen or methyl. Useful examples include FC-170C and FC-171, available from 3M. Another useful wetting agent is Triton™ X-100, available from Union Carbide.

Addition of a coalescing agent is also preferred for emulsion based coatings to insure that the coated material coalesces to form a continuous and integral layer and will not flake in conventional printing process. Compatible coalescing agents include propylcarbitol, available from Union Carbide as the Carbitol™ series, as well as the Cellusolve™ series, Propasolve™ series, Ektasolve™ and Ektasolve series of coalescing agents, also from Union Carbide. Other useful agents include the acetate series from Eastman Chemicals Inc., the Dowanol™ E series, Dowanol™ E acetate series, Dowanol™ PM series and their acetate series from Dow Chemical, N-methyl-2-pyrrolidone from GAF, and 3-hydroxy- 2,2,4-trimethyl pentyl isobutryate, available as Texanol™, from Eastman Chemicals Inc. These coalescing agents can be used singly or as a mixture.

Other optional ingredients may be present in the feed facilitation coating. Useful additives include such as crosslinking agents, catalysts, thickeners, adhesion promoters, glycols, defoamers and the like.

One preferred optional ingredient in the emulsion polymerized embodiment of the invention is an additional adhesion promotor to enhance durability of thicker coatings to the substrate. Useful adhesion promoters include organofunctional silanes having the following general formula:

$$R_2-Si(R_1)(R_3)-(CH_2)_n-Y$$

wherein $R_1$, $R_2$, and $R_3$ are selected from the group consisting of an alkoxy group and an alkyl group with the proviso that at least one alkoxy group is present, n is an integer from 0 to 4, and Y is an organofunctional group selected from the group consisting of chloro, methacryloxy, amino, glycidoxy, and mercapto. Useful silane coupling agents include such as γ-aminopropyl trimethoxysilane, vinyl triethoxy silane, vinyl tris(β-methoxy ethoxy)-silane, vinyl triacetoxy silane, γ-methacryloxypropyltrimethyoxy silane, γ-(β-amino ethyl)aminopropyl trimethoxysilane, and the like. The adhesion promotor may be present at levels of from 0.5 to 15% of the total resin, preferably from 4% to 10%.

The imaging surface may be simply the surface of the film, or preferably, the imaging surface is coated with an imaging coating. This imaging coating may be selected from any conventional image coating, comprising imaging polymers or oligomers, including but not limited to, those described below.

In one embodiment, the image coating contains an imaging polymer including polymers having the basic formula:

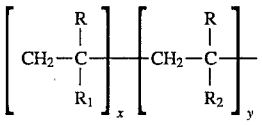

where R is selected from hydrogen or an alkyl group having 10 or fewer carbon atoms, an aryl group or alkyl substituted aryl group wherein the alkyl group has 10 or fewer carbon atoms, where $R_1$ is a pendant group selected from the group consisting of:

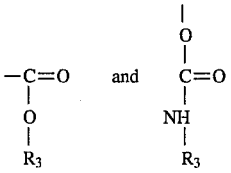

where $R_3$ is a long chain alkyl group having from about 14 to about 38 carbon atoms, preferably 14–18, where $R_2$ is selected from the group consisting of $R_1$,

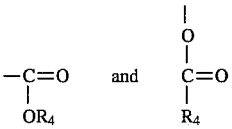

where $R_4$ is a short chain alkyl group having from 1 carbon atom to 15 carbon atoms, and where x and y are numbers related in that x+y comprises 100% of the polymer; x is from about 25% to about 100% of the final polymer, and y is from 0 to about 75% of the final polymer. Preferably x is from about 25% to about of the final polymer, and y is correspondingly from about 5% to about 75% of the final polymer. However, when $R_4$ is methyl, then Y comprises less than 50% of the final polymer for optimal print quality.

The image-receptive layer may be solely comprised of the image-receptive polymer which can be a homopolymer polymerized from alkyl acrylates and methacrylates having the general structure,

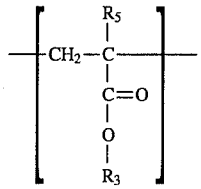

where $R_5$ represents hydrogen or —$CH_3$ and $R_3$ represents a member selected from the group consisting of alkyl group having from about 14 to about 38 carbon atoms, preferably from about 14 to about 18 carbon atoms.

The image-receptive polymer can also be copolymerized with the following additional monomers: Vinyl acetate, and vinyl benzene, α-methyl vinyl benzene having the formula:

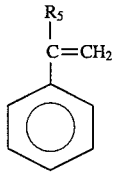

where $R_5$ represents hydrogen or —$CH_3$. Another constituent, $R_6$ can be selected from the group consisting of alkyl groups having up to 18 carbon atoms, halogen, hydroxide groups, alkoxy groups, acetyl groups and hydroxyalkyl groups, and can appear at the ortho, meta or para position to a vinyl group. The para position yields preferred structure. In addition to this imaging polymer, the image coating may also include a carrier polymer.

Carrier polymers may be selected from film-forming polymers such as ethylene bisphenol-A copolymers, such as those commercially available from E. I. DuPont Corporation (DuPont) as Atlac™ 382–05, copolyesters such as the Vitel™ PE 200, and PE 222, both commercially available from Goodyear Tire and Rubber Company, polyvinyl butyral, available as Butvar™ B72 and B76, available from Monsanto, polyvinylidene chloride acrylonitrile copolymers, available as Saran™ F310 from Dow Chemical, and polymethylmethacrylate, available as Elvacite™ 2041 from DuPont.

Preferred carrier polymers include Vitel™ PE200, and polyvinyl butyral, and PMMA.

When present, the carrier polymer comprises up to about 95% of the image-receptive layer, more preferably from about 50% to about 91%.

In another embodiment, imaging coatings comprise at least one amino functional silane coupling agent having the following formula:

$$(Q)_n R—Si(OR_1)_3$$

wherein Q is selected from the group consisting of primary, secondary and tertiary amino groups, preferably primary amino groups; R is selected from aliphatic and aromatic groups; $R_1$ is selected from the group consisting of alkyl and aryl groups, preferably an alkyl having from 1 to 10 carbon atoms; and n is 1 or 2.

Useful amino silanes include 3-aminopropyltrimethoxysilane, 3-aminopropyltriethyoxysilane, addition products of 3-glycidoxypropylalkoxy silane and secondary hydroxy alkylamines, and mixtures thereof.

These silanes can be further blended with other silane coupling agents including methyltrimethoxy silane, dimethyldiethoxy silane, methacrylolpropyl trimethoxy silane and dialkylamine addition products of the glycidoxypropylalkoxysilane, more preferably, tripropylamine addition products of the glycidoxypropyl dimethoxysilane.

The aminosilane coupling agent is present from about 5 parts to about 30 parts of the image-receptive layer, preferably from about 5 parts to about 25 parts, more preferably from about 5 parts to about 15 parts. At less than 5 parts, the coating layer formed tends to be hazy.

These amino silane coupling agents or blends are easily mixed with colloidal particles without destruction of the colloids to form a coating solution. Basic colloidal particles are present at levels of from about 60 parts to 85 parts, preferably from about 65 parts to 80 parts, more preferably from about 70 parts to 75 parts of the image-receptive layer. The colloidal particles useful in the present invention include colloidal silica particles such as nanometer sized silica particles in a basic environment, such as those available from Nalco Chemical Company as Nalco colloidal silicas 1030, 1115, 2327, 2326, 2329, 1130, 1140, 1040, 1050 and 1060, Ludox™ HS, LS, AS, AM, and SM colloidal silicas, available from DuPont; and SnowTex™ colloidal silicas such as ST-40, 50, C, N, S, XS and UP, available from Nissan Chemical Industry, Ltd., colloidal alumina sols such as Dispal™ 23N4-20, available from Vista Chemicals, and colloidal tin oxide sols such as Nyacol™ DP5730, available from Nyacol Products, Inc.

The average particle size of the basic colloidal particles is preferably less than 200Å, and more preferably less than 70Å.

To improve the cohesive and adhesive properties of this type of receptive layer, a polymeric binder, particularly a water-dispersible polymer binder is present. The amount of the binder varies from about 10 parts by weight to about 29.9 parts of the layer, and for image receptors designed to be used in thermal printers, preferably from about 10 parts to about 20 parts. For image receptors to be used with xerography, the preferred limits may be higher if higher film stretchability is desired, e.g., for further processing after coating of the imaging layer, but should be monitored carefully to avoid decreasing the improved image properties.

Useful polymeric binders include polyvinyl alcohol; polyvinyl acetate, gelatin, polyesters, copolyesters, sulfonated polyesters, polyamides, polyvinylpyrrolidones, copolymers of acrylic acid and/or methacrylic acid, and copolymers of polystyrenes.

In another embodiment, the image coating comprises a wax-compatible composition having a softening temperature in the range of about 30° C. to about 90° C., preferably having a critical surface tension of at least 31 dynes per cm, including such materials as chlorinated polyolefins, polycaprolactones, blends of chlorinated polyolefin and polymethyl methacrylate, block copolymers of styrene-ethylene/butylene-styrene, and copolymers of ethylene and vinyl acetate. Preferably, copolymers of ethylene and vinyl acetate should contain from about 10% to about 50% by weight polymethyl methacrylate. Waxes may also be incorporated into the layer in amounts of up to about 50%, preferably no more than 20%, most preferably no more than 12%. Useful waxes include microcrystalline wax, beeswax, carnauba wax, and synthetic hydrocarbon waxes.

In another embodiment, the image coating comprises oligomers comprising at least one addition product of at least two reactants, wherein one reactant is a 3-glycidoxypropylalkoxy silane and a second reactant is at least one secondary hydroxyalkylamine and the addition product has the formula:

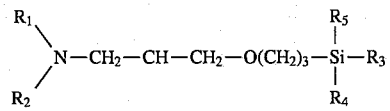

wherein at least one of $R^1$ or $R^2$ is a hydroxyalkyl group having 1–8 carbon atoms, preferably 1–8 carbon atoms, $R^1$ and $R^2$ can each be different or the same and include, e.g., methyl, ethyl, hydroxyl-ethyl, 2- and 3-hydroxypropyl, 2-, 3- and 4-hydroxybutyl, and 2,3,4,5,6-penta hydroxylhexyl; $R^3$ is an alkoxy group having 1–4 carbon atoms; and $R^4$ and $R^5$ are each selected from an alkyl group having 1–4 carbon atoms, and an alkoxy group having 1–4 carbon atoms.

Image coatings may also contain such conventional adjuvants as antiblocking agents, antistatic agents, surfactants, thickening agents, antioxidants, surface enhancers, and the like.

Film substrates may be formed from any polymer capable of forming a self-supporting sheet, e.g., films of cellulose esters such as cellulose triacetate or diacetate, polystyrene, polyamides, vinyl chloride polymers and copolymers, polyolefin and polyallomer polymers and copolymers, polysulphones, polycarbonates, polyesters, and blends thereof. Suitable films may be produced from polyesters obtained by condensing one or more dicarboxylic acids or their lower alkyl diesters in which the alkyl group contains up to 6 carbon atoms, e.g., terephthalic acid, isophthalic, phthalic, 2,5-, 2,6-, and 2,7-naphthalene dicarboxylic acid, succinic acid, sebacic acid, adipic acid, azelaic acid, with one or more glycols such as ethylene glycol, 1,3-propanediol, 1,4-butanediol, and the like.

Preferred film substrates are cellulose triacetate or cellulose diacetate, polyesters, especially polyethylene terephthalate, and polystyrene films. Polyethylene terephthalate is most preferred. It is preferred that film substrates have a caliper ranging from 50 μm to 150 μm. Films having a caliper of less than 50 μm are difficult to handle using conventional methods for graphic materials. Films having calipers over 150 μm are very stiff, and present feeding difficulties in certain commercially available copying machines.

When polyester film substrates are used, they can be biaxially oriented to impart molecular orientation before the imaging layer is coated thereon, and may also be heat set for dimensional stability during fusion of the image to the support. These films may be produced by any conventional extrusion method.

In one preferred embodiment, the polyester film substrate is formed by extrusion or casting. The feed facilitation layer is coated thereon immediately subsequent to formation thereof.

An image receptive coating can either be coated on the opposing side at this time, or at a later time. If the image receptive layer is coated at this time, or after uniaxial orientation, the layer is chosen such that it can withstand the subsequent processing without adverse effects. After coating, it is dried in an oven and then either uniaxially oriented in the machine direction followed by orientation in the transverse direction to produce a finished product, or simultaneously biaxially oriented to produce a finished product.

In another embodiment, the polyester film is extruded or cast, followed by uniaxial orientation in the machine direction. The feed facilitation layer is then coated thereon. Again, an image receptive coating can be coated on the opposing side at this time, or at a later time. If the image receptive layer is coated at this time, the layer is chosen such that it can withstand the subsequent processing without adverse effects. The composite can then undergo further orientation in the transverse direction to produce a finished product.

When either one of these processes is used, the coated layer exhibits evidence of such stretching under optical microscopy, but surprisingly, the coating remains transparent, and the polymer, whether emulsion or solution polymerized, exists in a continuous coated layer without voids, thus showing the high integrity and cohesiveness of the coated layer.

To promote adhesion of the feed facilitation layer to the film substrate, it may be desirable to treat the surface of the film substrate with one or more primers, in single or multiple layers. Useful primers include those known to have a swelling effect on the substrate polymer. Examples include halogenated phenols dissolved in organic solvents. Alternatively, the surface of the film substrate may be modified by treatment such as corona treatment or plasma treatment.

The primer layer, when used, should be relatively thin, e.g., preferably less than 2 μm, most preferably less than 1 μm, and may be coated by conventional coating methods.

Transparencies of the invention are particularly useful in the production of imaged transparencies for viewing in a transmission mode or a reflective mode, i.e., in association with an overhead projector.

The following examples are for illustrative purposes, and do not limit the scope of the invention, which is that defined by the claims.

Glossary

| | |
|---|---|
| BHT | 2 TERT-BUTYL 4-METHYL PHENOL |
| DMAEMA | DIMETHYLAMINOETHYL METHACRYLATE |
| EA | ETHYL ACRYLATE |
| GMA | GLYCIDYL METHYLACRYLATE |
| HBA | HYDROXYBUTYLACRYLATE |
| HEA | HYDROXYETHYLACRYLATE |
| HEMA | HYDROXYETHYL METHACRYLATE |
| IBOA | ISOBORNYL ACRYLATE |
| IBOMA | ISOBORNYL METHACRYLATE |
| LA/BDDA | LAURYLACRYLATE BUTANE-DIOLDIACRYLATE |
| MA | METHYL ACRYLATE |
| MMA | METHYL METHACRYLATE |
| NMP | N-METHYLPYRROLIDONE |
| PC | PROPYLCARBITOL |
| PMMA | POLYMETHYL METHACRYLATE |
| SMA | A 50/50 HEXANEDIOLDIACRYLATE/STEARYL METHACRYLATE BEAD |
| Z6040 | GLYCIDOXYPROPYL TRIMETHOXYSILANE |

Test Methods

Coefficient of Friction

The Coefficient of Friction (COF) of two stationary contacting bodies is defined as the ratio of the normal force "N", which holds the bodies together and the tangential force "$F_1$", which is applied to one of the bodies such that sliding against each other is induced.

A model SP-102B-3M90 Slip/Peel Tester, from Imass Co. was used to test the COF of articles of the invention. The feed facilitation-coated surfaces of two sheets are brought into contact with each other, with 1 sheet attached to a 1 kg brass sled, tethered to a force gauge and the second sheet attached to a moveable platen. The platen is drawn at a constant speed of 15.24 cm/min., and the maximum and average COF values are obtained from the tester readout and recorded.

Haze

Haze is measured with the Gardner Model XL-211 Hazeguard hazemeter or equivalent instrument. The procedure is set forth in ASTM D 1003-61 (Reapproved 1977). This procedure measures haze of the receptor construction without an image receptive coating.

Coating Durability Test

Durability is measured using the SP-102B-3M90 Slip/Peel Tester available from Imass, equipped with an MB-5 load cell. The platen speed is set at 15.24 cm/minute. A 1 cm×2 cm rubber is attached by a piece of double-coated tape to the middle of the sled with the 2 cm side parallel to the direction of the sliding motion. Test samples of the image receptive film are cut into 5 cm×20 cm and 2.5 by 5 cm pieces. The 5 cm×20 cm test piece is attached with double-coated tape to the left end of the platen and both sides of the 200 g sled weight just above and below the 1 cm×2 cm rubber. The 2 cm×5 cm test piece is then attached to the 200 g sled such that the 2 cm side is parallel to the 5 cm side of the rubber. Both test pieces are pressed to assure that they are flat and centered. They are then labeled and marked.

One end of a 12 Kg steel finishing line 20 cm in length is permanently connected to the 200 gms sled and the other end to the load cell. The sled is positioned above the left end of the platen and aligned with it to assure that the leader is in a relaxed state. The sled is then gently laid onto the test sample. 500 gms of additional weight is added to the sled and the platen is activated. After travelling for a distance of 8 cm, the platen is stopped and the sample removed to rate the durability. The ratings are according to the following scale:

1—positive for both coating removal and particle flaking.
2—negative for coating removal, positive to particle flaking.
3—positive for scratches, negative for both coating removal and particle flaking.
4—negative for scratches, coating removal and particle flaking.

Stack Feeding Test

This test defines the number of failures per total number of sheets fed. Receptor sheets are tested in a stack at various temperature and relative humidity conditions. Any jamming, misfeed, multiple feed or other problem during the printing process is recorded as a failure.

Preparation of Polymeric Beads

A. Preparation of Diethanolamine-Adipic Acid Condensate Promoter. Equimolar amounts of adipic acid and diethanolamine were heated and stirred in a closed reaction flask. Dry nitrogen was constantly bubbled through the reaction mixture to remove water vapor, which was condensed and collected in a Barrett trap. When 1– 1.5 mole(s) of water based on 1 mole of adipic acid and 1 mole of diethanolamine had been collected, the reaction was stopped by cooling the mixture. The resulting condensate was diluted with water.

B. An aqueous mixture of 600 g deionized water, 10 g Ludox SM-30 colloidal silica, available from DuPont, 2.4 gms of 10% solution of diethanolamine-adipic acid condensate promoter supra, and 0.13 gm of potassium dichromate were stirred and adjusted to pH 4 by addition of 10% sulphuric acid. A monomer solution of 32 gms of 1,3-butanediol diacrylate (BDDA, available from Sartomer), and 0.15 gm of Vazo™ 64, (available from DuPont) was added to 56 gm of the aqueous mixture and then stirred in a Waring blender for two minutes at the low speed setting.

The mixture was poured into a glass bottle which was then purged with nitrogen, sealed and placed in a shaker water bath at 70° C. for 20 hours. The contents of the bottle were then collected on a Buchner funnel and washed several times with water to yield a wet cake. The wet cake was dried at ambient temperature to give free-flowing powder.

Polymeric particles having other compositions could also be prepared using a similar procedure.

Preparation of Submicron Polymeric Beads

A mixture of 192 gms of 1,6-hexanedioldiacrylate, available from Sartomer, 192 gms of stearyl methacrylate, available from Rohm and Haas, and 1.2 gms of Vazo™ 64, available from DuPont was stirred in a beaker until the Vazo was completely dissolved. It was then added to a 2 liter resin flask containing 28.8 gms of "Dehyquart A", a 25% solution of cetyltrimethylammonium chloride, available from Henkel Corp., and 820 gms of DI water. The flask was then stirred at 700 rpm for 2 minutes. A coarse emulsion was obtained, which was then passed through a Manton-Gaulin Homogenizer from Gaulin Corp. at 500 psi. The emulsion was passed through the homogenizer a second time. The homogenized emulsion was then returned to the resin flask and heated to 60° C. It was maintained at the temperature for 15 hours under gentle agitation (400–500 rpm) with a nitrogen blanket. A stable emulsion was obtained having 30% submicron polymeric beads. Analysis on a Coulter N4 from Coulter Electronics, Inc. revealed an average particle size of 0.25 μm.

The Examples below are illustrative of the present invention and are not limiting in nature. Variations will be apparent to those skilled in the art. The scope of the invention is solely that which is defined by the claims.

EXAMPLES

Example 1

An emulsion polymer was prepared according to the following procedure:

A. Preparation of Emulsion Polymer

The following ingredients were admixed according to the procedures described below to make a latex binder for coating on transparency film. The compositions are shown in Table 1.

TABLE 1

| INGREDIENTS | WEIGHT % |
|---|---|
| Deionized Water | 73.9 |
| Triton ™ X405 (Union Carbide Chem. Co.) | 1.23 |
| Isobornyl Acrylate (CPS Chemical Co.) | 8.63 |
| Methyl Methacrylate (Rohm & Haas Co.) | 9.86 |
| Ethyl Acrylate (Rohm & Haas Co.) | 4.93 |
| Dimethyl Amino Ethyl Methacrylate (Rohm & Haas Co.) | 1.23 |
| Carbon Tetrabromide (Olin) | 0.05 |
| Ammonium Persulfate (J. T. Baker) | 0.07 |

To prepare the present emulsion polymer, Deionized water (DI water) and surfactant (Triton X405) were charged into a four-neck flask equipped with a reflux condenser, thermometer, stirrer, metering pump and a nitrogen gas inlet. This was stirred and heated to 70° C. under a nitrogen atmosphere. The monomers, IBOA, MMA, EA, DMAEMA and carbon tetrabromide (a chain transfer agent), were mixed in a separate container at room temperature to make the monomer premix. When the reaction temperature leveled off at 70° C., 20% of the monomer premix and the initiator (ammonium persulfate) were charged into the reactor to start the polymerization. The reaction was allowed to exotherm. At the exotherm peak, the remaining 80% monomer premix was fed into the reaction using a metering pump over a two-hour period while the reaction temperature was maintained at 70° C. After the monomer addition, the polymerization was continued for two hours at 70° C. to eliminate residual monomers. The latex was then cooled to 25° C. and filtered through a 25 μm filter.

B. Pre-Mix Preparation

Before mixing the bulk coating solution, pre-mixes of the two particulates were made in order to obtain adequate dispersion. Master batches of the 1.50 μm and 8 μm particles were made separately by mixing each type of particle with enough water to achieve a 25% solid suspension. Each master batch was mixed for 15 minutes after addition of the water.

After mixing for 15 minutes, the % solids of each premix was measured to verify 25% solids. 1.36 kg of the 1.5 μm premix and 6.82 kg of the 8 μm pre-mix were weighed from their respective master batches and combined with 6.82 kg of FC-170C (10% aqueous solution) in a separate container. This mixture was mixed for 15 minutes before addition to the coating solution which is described below.

C. Coating Solution Preparation 263.5 kg of de-ionized water was added to a 150 gallon mix tank. Under agitation provided by a 3 blade impeller, 3.41 kg "A-1120" was slowly added to the mixture. Agitation was maintained throughout the addition of the remaining ingredients, i.e., 68.2 g of Dow 65 was added slowly to the mixture, followed by a slow addition of 15.9 kg NMP, followed by 5.27 kg Cyastat™ 609. 143.5 kg of the latex was then added slowly to the mixture. Finally, the 15 kg of pre-mix described in section "B" above was added to the mixture. This completed the solution preparation yielding a 15.30% solids mixture.

D. Coating of the Latex Coating Solution

A 1200 μm thick polyethylene terephthalate (PET) film for use as a substrate was extruded at temperatures of about 250°–300° C. onto a casting wheel at a speed of about 25 meters/minute. The film was then uniaxially oriented in the machine direction about 3.2 times. The solution from C was coated onto one of the major surfaces of the film and the coated film was then dried in an oven at about 75° C. for about 10 seconds, yielding a dry coating weight of about 1,100 grams/meter$^2$.

After drying, the film was identically coated on the opposing side, and the second coating was dried in the same manner.

Finally, the film was oriented in the transverse direction 4.75 times to yield a dry coating weight of about 0.21 g/sq meter on each side.

This sheet was tested according to the test methods described and the results are shown in Table 2.

TABLE 2

| COF | HAZE | COATING DURABILITY | FEEDING FAILURES Tektronix Phaser ™ 200 | | Tektronix Phaser ™ II PXI | |
|---|---|---|---|---|---|---|
| .23 | 1.4 | 4 | 0/25 @ ambient temp. | 1/25 @ 29° C./ 80% RH | 2/37 @ ambient temp. | 2/25 @ 29° C./ 80% RH |

What is claimed is:

1. An image receptor comprising an oriented transparent polymeric substrate having two major surfaces, one major surface being an image surface, and one major surface being an opposing surface, and having coated on the opposing surface, a feed facilitation coating which aids in stack feeding by greatly reducing or eliminating multiple feeding tendencies, said coating having been coated from aqueous solution or emulsion, comprising:

a) from about 65 to about 99.9 parts of a transparent film-forming polymer, b) from about 0.1 to about 15 parts of at least one type of polymeric particles, said particles comprising 1) from 20 parts to 100 parts polymerized diol di(meth)acrylate having a formula $CH_2{=}CR^2COOC_nH_{2n}OOCCR^2{=}CH_2$ wherein $R^2$ is hydrogen or a methyl group, and n is an integer from 4 to 18, 2) from 0 to 80 parts of at least one copolymerized vinyl monomer having the formula $CH_2{=}CR^2COOC_mH_{2m+1}$ wherein $R^2$ is hydrogen or a methyl group and m is an integer of from 12 to 40, and 3) from 0 to 30 parts of at least one copolymerized ethylenically unsaturated monomer selected from the group consisting of vinyl esters, acrylic esters, methacrylic esters, styrene, and mixtures thereof, wherein 1), 2), and 3) comprise 100% of said polymeric particles, and c) from 0 to 20 parts of an antistatic agent selected from the group consisting of cationic agents, anionic agents, fluorinated agents, and nonionic agents.

2. A transparent image recording sheet according to claim 1 wherein said feed facilitation coating comprises an antistatic agent selected from the group consisting of steramidopropyldimethyl-β-hydroxy-ethyl ammonium nitrate, N,N'-bis(2-hydroxyethyl)-N-(3'-dodecyloxy- 2'2-hydroxylpropyl) methylammonium methylsulfate, and mixtures thereof.

3. A transparent image recording sheet according to claim 1 wherein said feed facilitation coating comprises particles selected from the group consisting of 50/50 poly(hexanediol-diacrylate/stearyl methacrylate) particles, 50/50 poly(butanedioldiacrylate)/lauryl(meth)acrylate particles, 80/20 poly (hexanedioldiacrylate)/stearyl(meth)acrylate particles, 50/50 polymethylmethacrylate/1,6 hexanedioldiacrylate particles, $C_{14}$ dioldiacrylate particles, and $C_{12}$ dioldi(meth)acrylate particles.

4. A transparent image-recording sheet according to claim 3 wherein said feed facilitation coating comprises additional particles having an average particle size which differs by at least 4 μm from the average particle size of said polymeric particles, said additional particles comprising copolymers of hexanedioldiacrylate, stearylmethacrylate and polymethylmethacrylate.

5. A transparent image-recording sheet according to claim 1 further comprising an image coating on said imaging surface.

6. A transparent image-recording sheet according to claim 5 wherein said imageable coating comprises a wax-compatible composition comprising at least one imageable polymer selected from the group consisting of chlorinated polyolefins, polycaprolactones, blends of chlorinated polyolefin and polymethyl methacrylate, block copolymers of styrene-ethylene/butylene-styrene, and copolymers of ethylene and vinyl acetate, wherein said imageable coating has a softening temperature of from about 30° C. to about 90° C., and a critical surface tension of at least 31 dynes per cm.

7. A transparent image-recording sheet according to claim 5 comprising an imageable polymer having the basic formula:

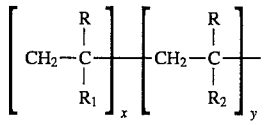

where R is selected from the group consisting of hydrogen, an alkyl group having up to about 10 carbon atoms, an aryl group, and an alkyl substituted aryl group wherein the alkyl group has up to about 10 carbon atoms, where $R_1$ is a pendant group selected from the group consisting of:

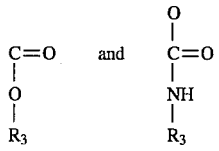

where $R_3$ is a long chain alkyl group having from about 14 to about 38 carbon atoms, where $R_2$ is selected from the group consisting of $R_1$,

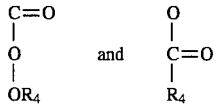

where $R_4$ is a short chain alkyl group having from 1 carbon atom to 15 carbon atoms, and where x, and y are numbers related in that x+y comprises 100% of the polymer; x is from about 25% to about 100% of the final polymer, and y is from 0 to about 75% of the final polymer.

8. A transparent image-recording sheet according to claim 5 wherein the image coating further comprises a polymer selected from the group consisting of ethylene bisphenol-A copolymers, copolyesters, polyvinyl butyral, polyvinylidene chloride, acrylonitrile copolymers, and polymethylmethacrylate.

9. A transparent image-recording sheet according to claim 5 wherein said imageable coating comprises from about 5 parts to about 30 parts of at least one amino functional silane coupling agent having the following formula:

$$(Q)_n R—Si(OR_1)_3$$

wherein Q is selected from the group consisting of primary, secondary and tertiary amino groups; R is selected from aliphatic and aromatic groups; $R_1$ is selected from the group consisting of alkyl and aryl groups; and n is 1 or 2.

10. A transparent image-recording sheet according to claim 9 wherein said amino functional silane coupling agent is selected from the group consisting of 3-aminopropyltrimethoxysilane, 3-aminopropyltriethyoxysilane, addition products of 3-glycidoxypropylalkoxy silane and secondary hydroxy alkylamines, and mixtures thereof.

11. A transparent image-recording sheet according to claim 10, said imageable coating further comprising a) from about 60 parts to 85 parts of a basic colloidal particle selected from the group consisting of colloidal silica particles, colloidal alumina sols, and colloidal tin oxide sols, and b) from about 10 parts to about 20 parts of a water-dispersible polymer binder selected from the group consisting of polyvinyl alcohol; polyvinyl acetate, gelatin, polyesters, copolyesters, sulfonated polyesters, polyamides, polyvinylpyrrolidones, copolymers of (meth)acrylic acid, and copolymers of polystyrenes.

12. A transparent image recording sheet according to claim 1 wherein said substrate is selected from the group consisting of polyesters, polystyrenes and cellulose triacetate.

* * * * *